US005738201A

United States Patent [19]

Findlay et al.

[11] Patent Number: 5,738,201

[45] Date of Patent: Apr. 14, 1998

[54] COMPOSITE COVER PLATE FOR ESCALATOR STEP

[75] Inventors: Alexander Findlay; Neil Forrest Reid, both of Auckland, New Zealand

[73] Assignee: Escalator Advertising Limited, Auckland, New Zealand

[21] Appl. No.: 637,104

[22] Filed: Apr. 24, 1996

[30] Foreign Application Priority Data

Apr. 28, 1995 [NZ] New Zealand ..... 272022

[51] Int. Cl.[6] ..... B66B 23/12

[52] U.S. Cl. ..... 198/333; 198/502.1

[58] Field of Search ..... 198/333, 502.1

[56] References Cited

U.S. PATENT DOCUMENTS

| | | | |
|---|---|---|---|
| 5,176,239 | 1/1993 | Findlay et al. | 198/333 |
| 5,411,127 | 5/1995 | Findlay | 198/333 |
| 5,439,090 | 8/1995 | Findlay | 198/333 |
| 5,441,140 | 8/1995 | Reid | 198/333 |

*Primary Examiner*—Joseph E. Valenza

*Attorney, Agent, or Firm*—Young & Thompson

[57] ABSTRACT

A coverplate for attachment over a sign or the like on the riser of an escalator step, having a profile complementary to the riser and to the trailing edge of the step below, comprised of a transparent polycarbonate material with a metal casting incorporated into it along an edge, to provide strength and rigidity and a wear-resistant rim to the coverplate.

7 Claims, 1 Drawing Sheet

COMPOSITE COVER PLATE FOR ESCALATOR STEP

FIELD OF THE INVENTION

Figure 1:
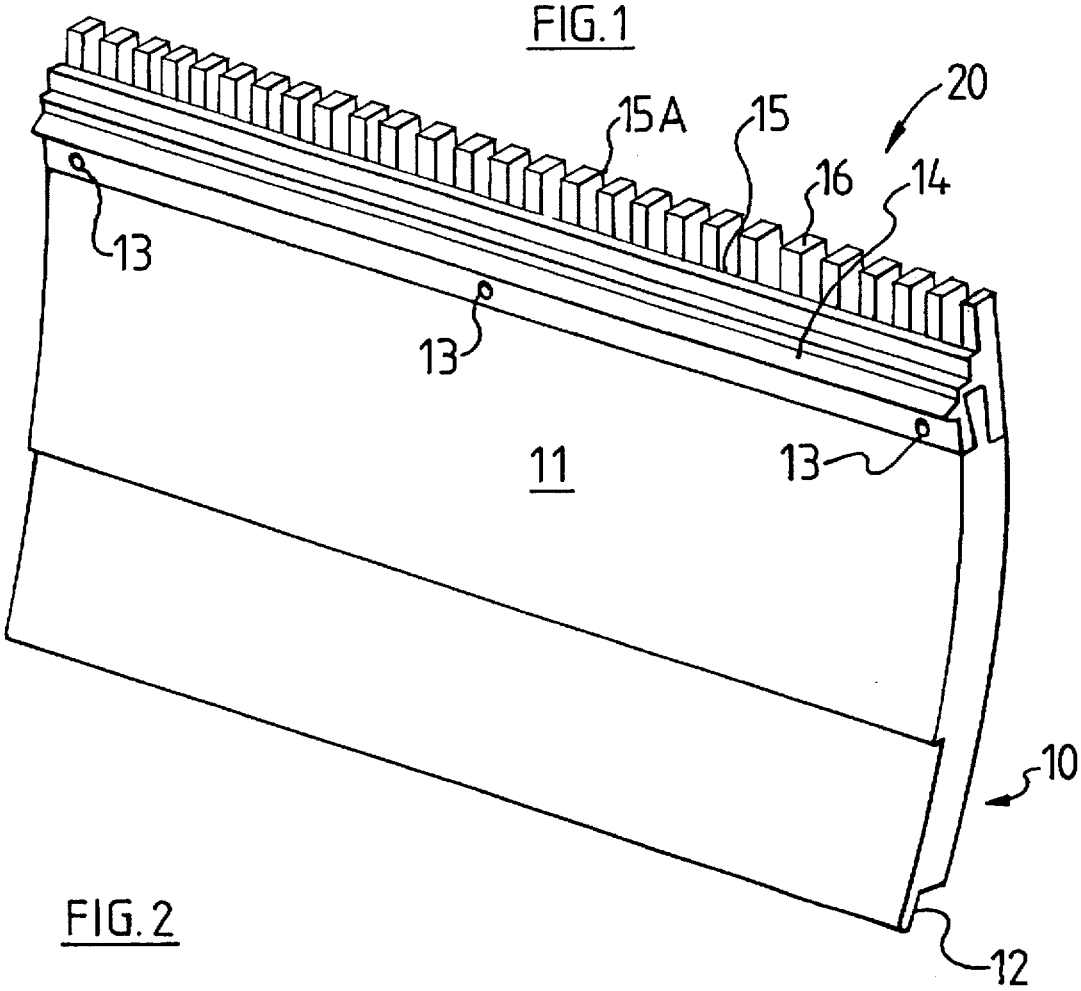

The present invention relates to the general field of advertising, with particular application to the mounting and presentation of advertising on escalators and travelators.

PRIOR ART

International patent application PCT/GB92/01037 published under the Patent Cooperation Treaty as No. WO 92/22491 shows and describes a system for mounting signs such as advertising or other indicia on an escalator or travelator, using a transparent cover to protect the sign and to re-create the original profile of the step, including the cleats and channels by which adjacent steps are interlocked. The cleats and channels of the cover are aligned with remaining cleats and channels on the riser itself.

A potential problem with the above system may be found, if the cleats of the cover are slightly out of alignment with those of the riser. As adjacent steps move relative to each other, projecting teeth at the trailing edge of a lower step pass between the cleats on the riser of the step above. Misalignment may result in the corners of cleats on the cover being chipped or cracked. These corners may also be prone to damage in use, if kicked or otherwise struck as people use the escalator.

OBJECT

It is an object of the present invention to go at least partway towards overcoming the above problem, or at least to provide the public with a useful choice.

STATEMENT OF INVENTION

In one aspect the present invention provides a cover adapted for mounting on a step of a passenger conveying device such as an escalator or travelator, having an external profile complementary to an external profile of said step, characterised in that said cover is comprised of an at least partially transparent or translucent panel (11) and a beading (20) fastened along at least one edge of said panel, said beading being comprised of a wear-resistant material.

Preferably the external profile of the cover includes a plurality of substantially vertical cleats on a face of said cover, and tips of said cleats are comprised by said beading of wear-resistant material.

Preferably the beading is formed from a metal casting, and said casting is set in said panel during moulding of said panel.

Preferably the tips of the cleats project incorporates one or more fastening apertures therein, by which said cover may be fastened to said step in use.

Preferably the tips of the cleats project substantially beyond a body of said panel and said beading, to extend across a portion of said step.

In another aspect the present invention provides a method of fabricating a cover adapted for mounting on a step of a passenger conveying device such as an escalator or travelator, having an external profile complementary to an external profile of said step, characterised by the steps of producing a metal beading (20), and fixing said beading to an at least partially transparent or translucent panel (11), at an exposed edge of said panel.

Preferably the step of inserting said beading in a mould for producing said panel, and setting said beading in the material of said panel.

DRAWINGS

These and other aspects of the present invention may be made apparent in the following description of a preferred embodiment, given by way of example only, with reference to the accompanying drawings, in which:

FIG. 1: illustrates a preferred embodiment of the present invention in rear perspective view.

Figure 2:
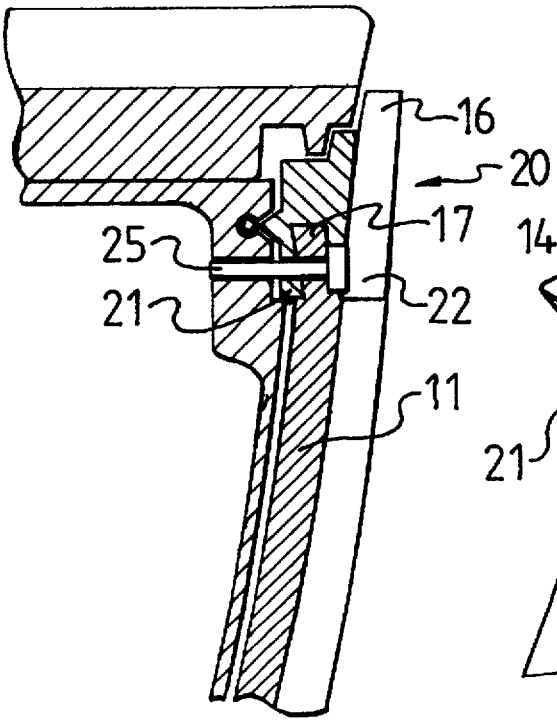

FIG. 2: illustrates the apparatus of FIG. 1 in side view and cross-section.

Figure 3:
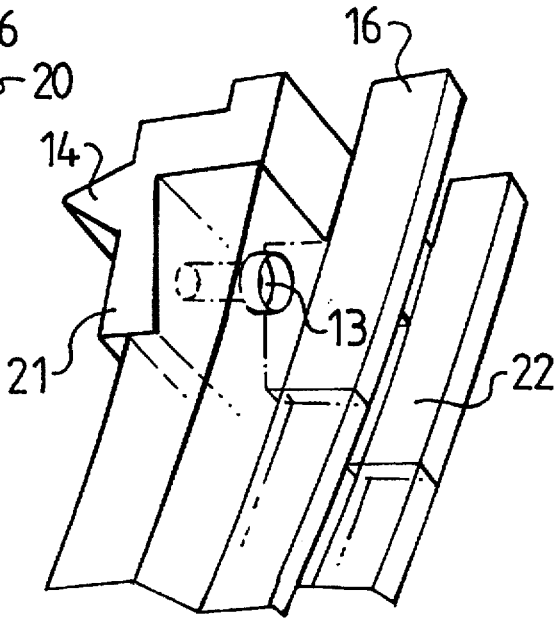

FIG. 3: illustrates detail of the apparatus of FIG. 1 in front perspective view.

PREFERRED EMBODIMENT

As shown in FIG. 1, a preferred form of the present invention comprises a coverplate 10 shaped for fastening in a recessed riser of an escalator step. Specific details of proportion and dimension may be altered considerably within the scope of the present invention, to suit application to different steps, but generally a coverplate 10 may be comprised of a slightly radiused transparent or translucent panel 11 having a projecting lip 12 along its lower edge, a number of fastening apertures 13 and a rearwardly projecting lip 14 at or near the upper edge, and parallel, substantially vertical cleats 15A on a front face 15 of the coverplate 10. The cleats 15A are spaced and arranged to complement the trailing edge of a lower adjacent step (not shown). The rearwardly projecting lip 14 is arranged to engage with a weatherseal mounted in the riser, as shown in FIG. 2, and should similarly be shaped and adapted to suit the construction and arrangement of the riser.

The rearwardly projecting lip 14, fastening apertures 13, and upper tips 16 of the cleats 15A are preferably all provided on a metal beading 20, fixed along the top edge of the transparent or translucent panel 11. Preferably the beading 20 is cast from aluminium, but it will be appreciated that a variety of other materials might be used instead.

As shown particularly in FIGS. 2 and 3, the beading 20 is fixed to the top of the panel 11 with a form of tongue in groove joint, with a flange 17 of the panel 11 fixed between a rear face 21 of the beading 20 and downwardly projecting, portions 22 of the cleat tips 16. Preferably the beading 20 is placed in the mould for forming the panel 11, so that it is set in place, but alternatively it could be fixed in place subsequent to moulding. As shown, the fastening apertures 13 pass through both the flange 17 of the panel 11 and the rear face 21 of the beading 20, so that in use the fasteners 25 used to mount the plate 10 on the riser of a step will also serve to fasten the two components of the plate 10 together.

As shown in FIG. 2, the cleat tips 16 on the beading 20 project upwardly from the plate 10, so that in use the entire cleats over that section of the riser are provided on the coverplate 10, rather than partly being comprised of cleat sections on the riser itself. The beading 20 is sufficiently strong that these projecting cleat tips are not liable to be damaged or broken off in normal use, and by this means misalignment between cleat sections can be avoided.

It will be appreciated that many changes and modifications might be made to the above construction, within the general spirit and scope of the present invention. While an aluminium casting 20 is preferred for use in forming the top edge of the coverplate 10, it will be appreciated that a steel casting could be used, a hard plastic moulding, or a fabrication from extruded or folded metal. A two piece metal construction could be used, and assembled with the flange 17 of the panel 11 clipped between them.

Fabrication might be finished after the panel 11 and beading 20 have been fixed together, with (for example) grooves between cleans 15A and cleat tips 16 are being milled out after assembly, to avoid any flash or misalignment between them. Similar beadings might be provided on the lower edge of the panel and/or the side edges, to suit a particular application or visual style.

A wide variety of cosmetic modifications might also be made, and modifications to suit specific details of the escalator step construction or useage. Various other changes and modifications might also be made to the above example within the scope of the present invention, as characterised by the following claims.

We claim:

1. A cover (10) adapted for mounting on a step of a passenger conveying device such as an escalator or travelator, having an external profile complementary to an external profile of said step, characterised in that said cover is comprised of an at least partially transparent or translucent panel (11) and a beading (20) fastened along at least one edge of said panel, said beading being comprised of a wear-resistant material.

2. A cover as claimed in claim 1, wherein said cover is adapted to fit on a riser of an escalator step characterised in that said external profile of the cover includes a plurality of substantially vertical cleats on a face of said cover, and tips of said cleats are comprised by said beading of wear-resistant material.

3. A cover as claimed in claim 2, characterised in that said beading is formed from a metal casting, and said casting is set in said panel during moulding of said panel.

4. A cover as claimed in claim 3, characterised in that said beading incorporates one or more fastening apertures therein, by which said cover may be fastened to said step in use.

5. A cover as claimed in claim 4, characterised in that said tips of said cleats project substantially beyond a body of said panel and said beading, to extend across a portion of said step.

6. A method of fabricating a cover (10) adapted for mounting on a step of a passenger conveying device such as an escalator or travelator, having an external profile complementary to an external profile of said step, characterised by the steps of producing a metal beading (20), and fixing said beading to an at least partially transparent or translucent panel (11), at an exposed edge of said panel.

7. A method as claimed in claim 6, characterised by the step of inserting said beading in a mould for producing said panel, and setting said beading in the material of said panel.

* * * * *